US006820999B2

(12) United States Patent
Kotovsky et al.

(10) Patent No.: US 6,820,999 B2
(45) Date of Patent: Nov. 23, 2004

(54) MOTORIZED LAMP

(75) Inventors: Irwin Kotovsky, 3941 California Ave., Pittsburgh, PA (US) 15212; Serge Cornelissen, Roeselare (BE); Robert Cornelissen, Roeselare (BE)

(73) Assignee: Irwin Kotovsky, Pittsburgh, PA (US)

( * ) Notice: Subject to any disclaimer, the term of this patent is extended or adjusted under 35 U.S.C. 154(b) by 0 days.

(21) Appl. No.: 10/123,798

(22) Filed: Apr. 12, 2002

(65) Prior Publication Data

US 2003/0193809 A1 Oct. 16, 2003

(51) Int. Cl.[7] ..... F21V 9/00

(52) U.S. Cl. ..... 362/285; 362/233; 362/366; 362/428

(58) Field of Search ..... 362/233, 272, 362/286, 285, 386, 366, 428

(56) References Cited

U.S. PATENT DOCUMENTS 3,743,828 A * 7/1973 Florenzo et al. ..... 40/444
3,818,217 A * 6/1974 Hetz ..... 362/131
4,930,057 A * 5/1990 Williams ..... 362/272
4,935,853 A * 6/1990 Collins ..... 362/272
4,935,855 A * 6/1990 Narita ..... 362/286
5,490,046 A * 2/1996 Gohl et al. ..... 362/35
5,513,085 A * 4/1996 Bourne ..... 362/286
5,526,245 A * 6/1996 Davis et al. ..... 362/233
5,584,560 A * 12/1996 Gosswiller et al. ..... 362/66
5,609,408 A * 3/1997 Targetti ..... 362/66
5,673,989 A * 10/1997 Gohl et al. ..... 362/35
5,806,956 A * 9/1998 Hyun-Jo ..... 362/35
6,283,603 B1 * 9/2001 Lin ..... 362/35
6,540,374 B2 * 4/2003 Kira et al. ..... 362/153.1

* cited by examiner

*Primary Examiner*—Thomas M. Sember
*Assistant Examiner*—Jacob Y. Choi
(74) *Attorney, Agent, or Firm*—Ansel M. Schwartz

(57) ABSTRACT

A system for lighting. The system includes at least a first lamp for producing light. The system includes motorized means for positioning the first lamp in a desired position. The motorized means is connected to the lamp. A method for lighting. The method includes the steps of directing a first motor with a controller. There is the step of positioning a first lamp into a desired position with the first motor.

19 Claims, 3 Drawing Sheets

MOTORIZED LAMP

FIELD OF THE INVENTION

The present invention is related to a motorized lamp fixture. More specifically, the present invention is related to a motorized lamp fixture that has a first drive element and a second drive element for moving the lamp in a first dimension and a second dimension, respectively, for positioning the lamp in a desired position.

BACKGROUND OF THE INVENTION

Directed lighting fixtures are found in many locations. These locations include places that are generally inaccessible without a ladder or other equipment that allows the fixture to be reached, for instance, to change the lamp, or reconfigure the direction of the lamp. If the lamp needs to be reconfigured, then the ladder or special equipment must be brought out and the fixture reached and the direction of the lamp changed. Alternatively, when the lamp must be replaced, many times, the direction of the lamp is changed upon its removal, and upon replacement, it must be redirected to shine its light onto a desired area. In many instances, the alignment of the lamp is a very tedious operation, and when standing on a ladder, or using special equipment, is made all that more difficult. Consequently, the redirection or the replacement of the lamp is commonly a very time-consuming exercise.

The present invention allows for the redirection of a lamp, whether the lamp has just been replaced and needs to be repositioned into its desired position, or moved to a new position, by remote control with the use of a motorized system that moves the lamp.

SUMMARY OF THE INVENTION

The present invention pertains to a system for lighting a room having a ceiling. The system comprises at least a first lamp for producing light. The system comprises motorized means adapted to be disposed in the ceiling for positioning the first lamp in a desired position by moving the first lamp, preferably linearly. The motorized means is connected to the lamp.

The present invention pertains to a method for lighting. The method comprises the steps of directing a first motor disposed in a ceiling of a room with a controller. There is the step of positioning a first lamp into a desired position with the first motor by moving the first lamp linearly.

BRIEF DESCRIPTION OF THE DRAWINGS

In the accompanying drawings, the preferred embodiment of the invention and preferred methods of practicing the invention are illustrated in which.

DETAILED DESCRIPTION

Figure 1:
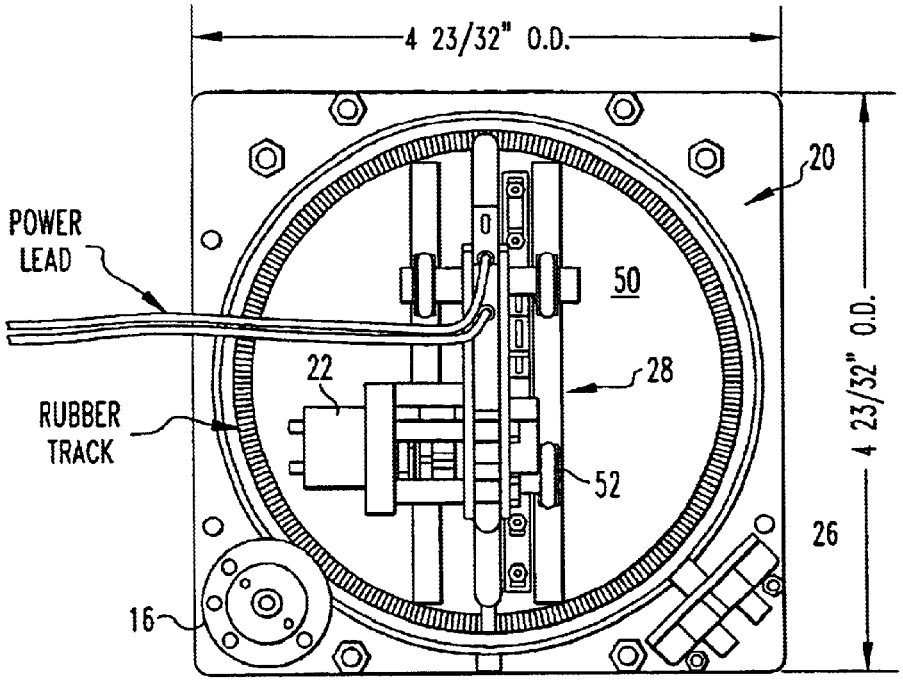
FIG. 1 is a schematic representation of a top view of a system of the present invention.

Referring now to the drawings wherein like reference numerals refer to similar or identical parts throughout the several views, and more specifically to FIGS. 1–5 thereof, there is shown a system 10 for lighting a room having a ceiling. The system 10 comprises at least a first lamp 12 for producing light. The system 10 comprises motorized means 14 adapted to be disposed in the ceiling for positioning the first lamp 12 in a desired position by moving the first lamp, preferably linearly. The motorized means 14 is connected to the lamp.

Preferably, the motorized means 14 includes a first motor 16 for moving the lamp to the desired position. The system 10 preferably includes a controller 18 for controlling the first motor 16, the controller 18 is in communication with the first motor 16. Preferably, the motorized means 14 includes a drive train 20 connected to the first motor 16 and the first lamp 12, the first motor 16 moves the drive train 20 to place the first lamp 12 in the desired position. The motorized means 14 preferably includes a second motor 22 for moving the lamp to the second position, the second motor 22 connected to the drive train 20 to move the first lamp 12 in the desired position.

Preferably, the motorized means 14 includes a lamp attachment means 24 for holding the first lamp 12 and connected to the drive train 20. The drive train 20 preferably includes a first drive element 26 for moving the first lamp 12 in a first dimension, the first drive element 26 connected to the first motor 16. Preferably, the drive train 20 includes a second drive element 28 for moving the first lamp 12 in a second dimension, the second drive element 28 connected to the second motor 22.

The controller 18 preferably has a transmitter 30 which transmits a drive signal to the first motor 16 or to the second motor 22, and the first motor 16 and the second motor 22 each have a receiver 32 which receives the drive signal. Preferably, the transmitter 30 and each receiver 32 communicate by wire or by wireless.

The first drive element 26 preferably includes a first set of wheels 34 with grooves 36, and a first set of first bands that fit about the first set of wheels 34 and grooves 36, as the first set of wheels 34 turn, the first set of bands 38 are moved, causing the first lamp 12 to move to the desired position. Preferably, the second drive element 28 includes a second set of wheels 40 with grooves 36, and a second set of bands 42 that fit about the second set of wheels 40, as the second set of wheels 40 turn, the second set of bands 42 are moved, causing the first lamp 12 to move to the desired position. The first drive element 26 alternatively includes a first set of gears 44 which interact causing the first lamp 12 to move to the desired position. Alternatively, the second drive element 28 includes a second set of gears 46 which interact causing the first lamp 12 to move to the desired position. The system 10 preferably includes N additional lamps and N additional motorized means 14 in communication with the respective lamps and the controller 18. The controller 18 controls the N motorized means 14 so each of the N lamps is placed in a respective desired position independent of any other of the N lamps.

The present invention pertains to a method for lighting. The method comprises the steps of directing a first motor 16 disposed in a ceiling of a room with a controller 18. There is the step of positioning a first lamp 12 into a desired position with the first motor 16 by moving the first lamp linearly.

Preferably, the positioning step includes the step of moving a drive train 20 connected to the first lamp 12 with the first motor 16 to move the first lamp 12 in the desired position. The moving step preferably includes the step of moving a first drive element 26 of the drive train 20 with the first motor 16 to position the first lamp 12 in a first dimension. Preferably, the moving step includes the step of moving a second drive element 28 of the drive train 20 with a second motor 22 to position the first lamp 12 and a second dimension. The moving step preferably includes the step of moving a lamp attachment means 24 for holding the first lamp 12 that is connected to the drive train 20 with the first motor 16 and the second motor 22.

Preferably, the directing step includes the step of sending a drive signal from a controller 18 to the first motor 16 and the second motor 22 to cause the first motor 16 and the second motor 22 to moved the first drive element 26 and the second drive element 28, respectively, to position the first lamp 12 and the desired position. The sending step preferably includes the step of sending the drive signal on a wire or wireless to the first motor 16 and the second motor 22. Preferably, there is the step of moving N additional lamps with N respective motors, where N is greater than or equal to one and is an integer, with the controller 18 to respective desired positions.

In the operation of the invention, a fixture 48 is attached to a ceiling or wall by well known techniques. The fixture 48 has motorized means 14 for positioning a first lamp 12 in a desired position. The motorized means 14 comprises a drive train 20 that is used to position the lamp in a desired position. The drive train 20 has a first drive element 26 comprising a rubber edged track 50, in the form of a circular plate, that is positioned in a horizontal plane relative to the fixture 48 and rubber wheels 52 disposed at the corners of the fixture 48. The rubber wheels 52 are disposed such that there are two rubber wheels 52 at each corner with a space between each rubber wheel at each corner forming a groove. The rubber edged track 50 is positioned within the grooves 36 that are formed by the rubber wheels 52 at each corner. The rubber wheels 52 turn and move, as well as guide, the rubber edged track 50 as the rubber wheels 52 move. The first motor 16 disposed at a corner of the fixture 48, aligns with and engages the pair of rubber wheels 52 at the same corner it is disposed at. The first motor 16 moves the rubber wheels 52 to which it is attached, causing the rubber edged track 50 to move as it is guided by the rubber wheels 52 at the other corners of the fixture 48. The movement of the rubber edged track 50 moves the lamp in the first dimension. It should be noted the track and wheels do not have to be rubber, but metal, ceramic or plastic.

Figure 4:
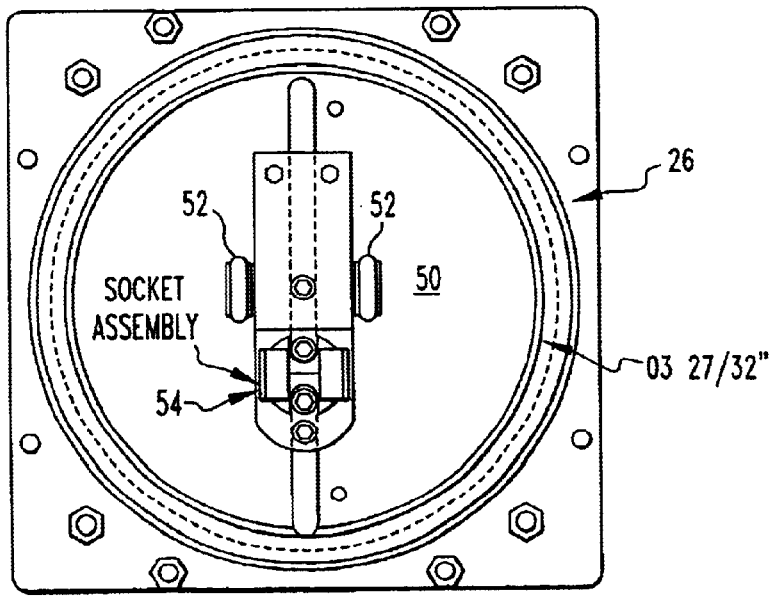
FIG. 4 is a schematic representation of a bottom review of the system.
Figure 2:
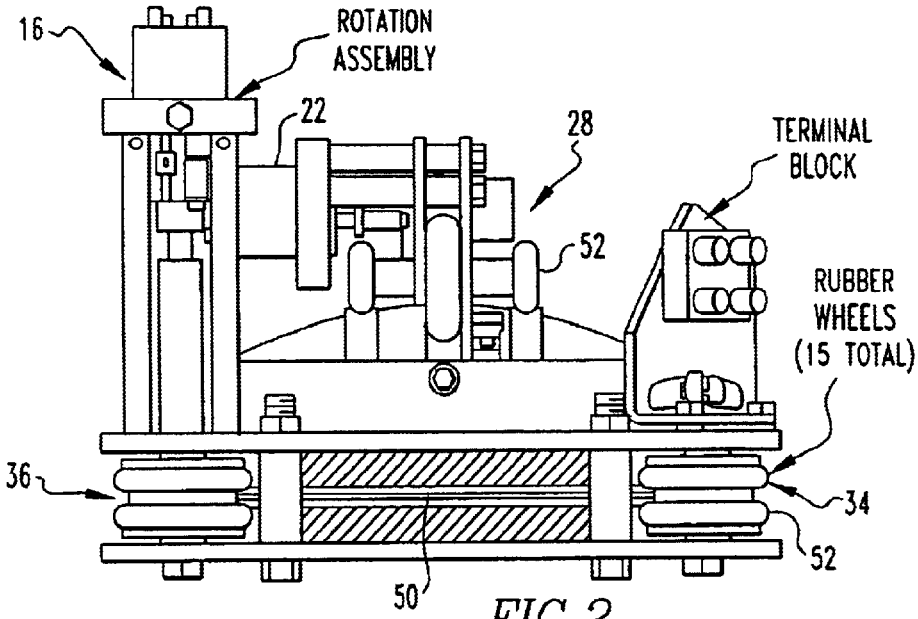
FIG. 2 is a schematic representations of a side view of the system.
Figure 3:
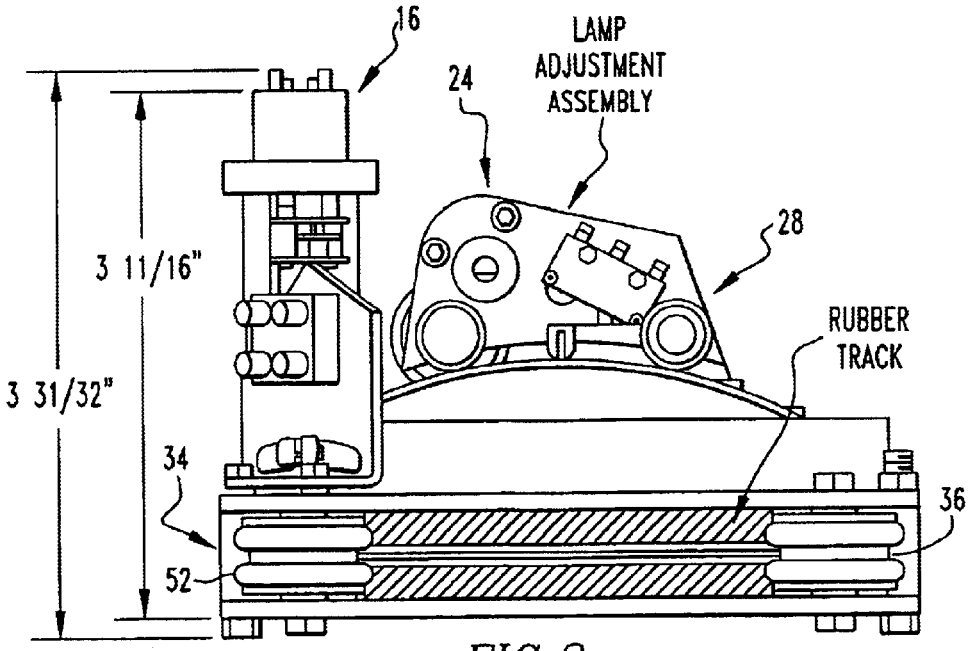
FIG. 3 is a schematic representation of an end view of the system.

Positioned across the center of the rubber edged track 50 is a second drive element 28 of the drive train 20. The second drive element 28 is linear, includes a linear track that has a variable slope, and also has wheels that are mounted on the lamp adjustment assembly. The lamp adjustment assembly and the wheels that are mounted to it form the lamp attachment means 24. The movements of the lamp adjustment assembly from the action of the second motor 22 attached to and driving the wheels on it, moves the lamp in a second dimension by moving along the linear track to a desired position on the variable slope so the lamp is caused to aim at a desired location. Mounted on the underside of the track is a socket assembly 54 for holding the lamp, as shown in FIG. 4. The socket assembly 54 is part of the lamp attachment means 24. Movement of the rubber track by the first motor 16 moves the lamp along a first plane and movement of the lamp adjustment assembly in the second plane allows the lamp to be positioned in the second dimension, and together with respect to both dimensions the lamp can be placed in a desired position.

Alternatively, but instead of rubber rings and wheels, gears can be used to move the lamp adjustment assembly to any desired position. Power leads extend from the lamp adjustment assembly and are connected to the second assembly to provide electricity to the lamp.

A controller 18 that is disposed remote from the fixture 48 provides a drive signal to the first motor 16 and to the second motor 22 to cause them to move the first drive element 26 and second drive element 28, respectively, into a desired position so the lamp is moved into a desired position. The controller 18 can have a keyboard in which the coordinates of each respective drive element is inputted, or a joy stick or wheel or mouse, with a switch that determines which drive element is being controlled at a given time, to move the lamp into the desired position. A memory that is part of the controller 18, can store a desired position that is chosen for the lamp relative to the first drive element 26 and the second drive element 28. The controller can store the location of the lamp relative to each dimension so it knows where the lamp of a given fixture is at all times. Then, since the controller knows where the lamp is relative to each drive element, it can move the lamp relative to each drive element to a new position.

Figure 5:
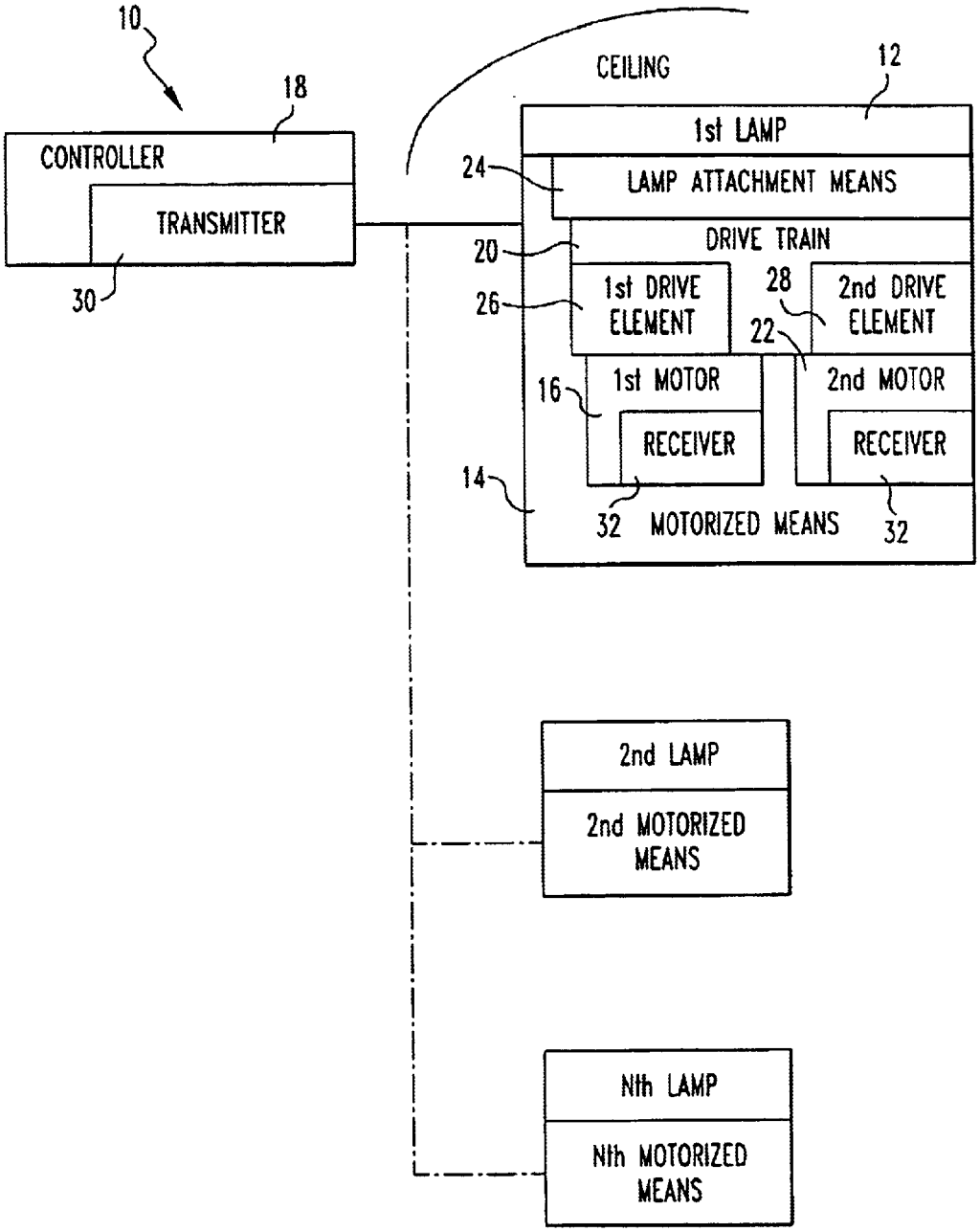
FIG. 5 is a schematic representation of a controller and a plurality of lamps in a ceiling.

The controller 18 is connected to each motor through wires, or wireless and uses electromagnetic radiation, such as radio signals or infrared signals to input the drive signals to the motors. The controller 18 has a transmitter 30 which transmits a drive signal, and each motor has a receiver 32 which receives the drive signal and activates the respective motor according to its drive signal. Connected to the controller 18 are additional fixtures 48 with motorized means 14 and motors that are controlled by the controller 18 in the same way as described above in regard to the fixture 48, as shown in FIG. 5.

Although the invention has been described in detail in the foregoing embodiments for the purpose of illustration, it is to be understood that such detail is solely for that purpose and that variations can be made therein by those skilled in the art without departing from the spirit and scope of the invention except as it may be described by the following claims.

What is claimed is:

1. A system for lighting a room having a ceiling comprising:

at least a first lamp for producing light; and motorized means disposed in the ceiling for positioning the first lamp in a desired position by moving the first lamp linearly, the motorized means is connected to the lamp, the motorized means includes a first motor for moving the lamp linearly in a first dimension to the desired position and a second motor for moving the lamp in a second dimension, the motorized means includes a drive train having a first drive element and a first track connected to the first motor and the first lamp and a second drive element having a second track connected to the first lamp, the first motor moves the first drive element along the first track and the second motor moves the second drive element along the second track to place the first lame in the desired position.

2. A system as described in claim 1 wherein the motorized means includes a first motor for moving the lamp to the desired position.

3. A system as described in claim 2 including a controller for controlling the first motor, the controller is in communication with the first motor.

4. A system as described in claim 3 wherein the second motor moves the lamp to the second position, the second motor connected to the drive train to move the first lamp in the desired position.

5. A system as described in claim 4 wherein the motorized means includes a lamp attachment means for holding the first lamp and connected to the drive train.

6. A system as described in claim 1 wherein the controller has a transmitter which transmits a drive signal to the first motor or to the second motor, and the first motor and the second motor each have a receiver which receives the drive signal.

7. A system as described in claim 6 wherein the transmitter and each receiver communicate by wire or by wireless.

8. A system as described in claim 7 wherein the first drive element includes a first set of wheels with grooves, and a first set of bands that fit about the first set of wheels and grooves, as the first set of wheels turn, the first set of bands are moved, causing the first lamp to move to the desired position.

9. A system as described in claim 8 wherein the second drive element includes a second set of wheels with grooves, and a second set of bands that fit about the second set of wheels, as the second set of wheels turn, the second set of bands are moved, causing the first lamp to move to the desired position.

10. A system as described in claim 7 wherein the first drive element includes a first set of gears which interact causing the first lamp to move to the desired position.

11. A system as described in claim 7 wherein the second drive element includes a second set of gears which interact causing the first lamp to move to the desired position.

12. A system as described in claim 11 including N additional lamps and N additional motorized means in communication with the respective lamps and the controller, the controller controlling the N motorized means so each of the N lamps is placed in a respective desired position independent of any other of the N lamps, where $N \geqq 1$ and is an integer.

13. A method for lighting comprising the steps of:

directing a first motor and a second motor disposed in a ceiling of a room with a controller; and positioning a first lamp into a desired position with the first motor by moving the first lamp linearly in a first dimension with respect to a first drive element and with the second motor in a second dimension with respect to a second drive element.

14. A method as described in claim 1 wherein the moving step includes the step of moving a lamp attachment means for holding the first lamp that is connected to the first drive element with the first motor and the second motor.

15. A method as described in claim 14 wherein the directing step includes the step of sending a drive signal from a controller to the first motor and the second motor to cause the first motor and the second motor to moved the first drive element and the second drive element, respectively, to position the first lamp and the desired position.

16. A method as described in claim 15 wherein the sending step includes the step of sending the drive signal on a wire or wireless to the first motor and the second motor.

17. A method as described in claim 16 including the step of moving N additional lamps with N respective Motors, where N is greater than or equal to one and is an integer, with the controller to respective desired positions.

18. A method as described in claim 13 wherein the moving step includes the step of moving the first drive element linearly along a first track.

19. A method as described in claim 18 wherein the moving step includes the step of moving the second drive element along a second track.

* * * * *